US009890752B2

(12) United States Patent
Hartmann et al.

(10) Patent No.: US 9,890,752 B2
(45) Date of Patent: Feb. 13, 2018

(54) MUFFLER

(71) Applicant: Henn GmbH & Co KG., Dornbirn (AT)

(72) Inventors: Harald Hartmann, Dornbirn (AT); Christian Hubmann, Hohenems (AT)

(73) Assignee: Henn GmbH & Co KG., Dornbirn (AT)

( * ) Notice: Subject to any disclaimer, the term of this patent is extended or adjusted under 35 U.S.C. 154(b) by 0 days.

(21) Appl. No.: 15/122,693

(22) PCT Filed: Mar. 6, 2015

(86) PCT No.: PCT/AT2015/050059
§ 371 (c)(1),
(2) Date: Aug. 31, 2016

(87) PCT Pub. No.: WO2015/131217
PCT Pub. Date: Sep. 11, 2015

(65) Prior Publication Data

US 2017/0074220 A1 Mar. 16, 2017

(30) Foreign Application Priority Data

Mar. 7, 2014 (AT) ..... A 50168/2014

(51) Int. Cl.
*F02M 35/12* (2006.01)
*F01N 1/02* (2006.01)
(Continued)

(52) U.S. Cl.
CPC ..... *F02M 35/1266* (2013.01); *F02B 33/44* (2013.01); *F02M 35/1255* (2013.01);
(Continued)

(58) Field of Classification Search
CPC ..... F02M 35/1036; F02M 35/1266; F02M 35/1283; F01N 13/1888; F01N 1/026
(Continued)

(56) References Cited

U.S. PATENT DOCUMENTS 6,298,816 B1 10/2001 Marentette
7,958,728 B2 6/2011 Dumas et al.
(Continued)

FOREIGN PATENT DOCUMENTS

DE 199 57 597 A1 5/2001
DE 10026355 A1 1/2002
(Continued)

OTHER PUBLICATIONS

International Search Report of PCT/AT2015/050059, dated Jul. 30, 2015.

*Primary Examiner* — Jeremy Luks
(74) *Attorney, Agent, or Firm* — Collard & Roe, P.C.

(57) ABSTRACT

The invention relates to a muffler (1), in particular a vehicle muffler, comprising at least one resonator chamber (12), which is bounded by at least a first housing part (2) having a first outer jacket (15) and a first end wall (16) in which an inflow opening (19) is disposed arranged on the inflow side (25), and a first internal pipe segment (20). Furthermore, at least one coupling device (6) for coupling to a turbocharger (9) is provided, which is accommodated in the first end wall (16) of the first housing part (2). The coupling device (6) comprises a coupling body (7) which is designed as a deep-drawn part. The first housing part (2) is likewise formed by a deep-drawn part, and the inflow opening (19) of the first housing part (2) has an extension which is tapered in steps man axial section (23) in which the coupling body (7) and a sealing element (27), such as a radial sealing ring, are accommodated.

12 Claims, 5 Drawing Sheets

Figure 1:
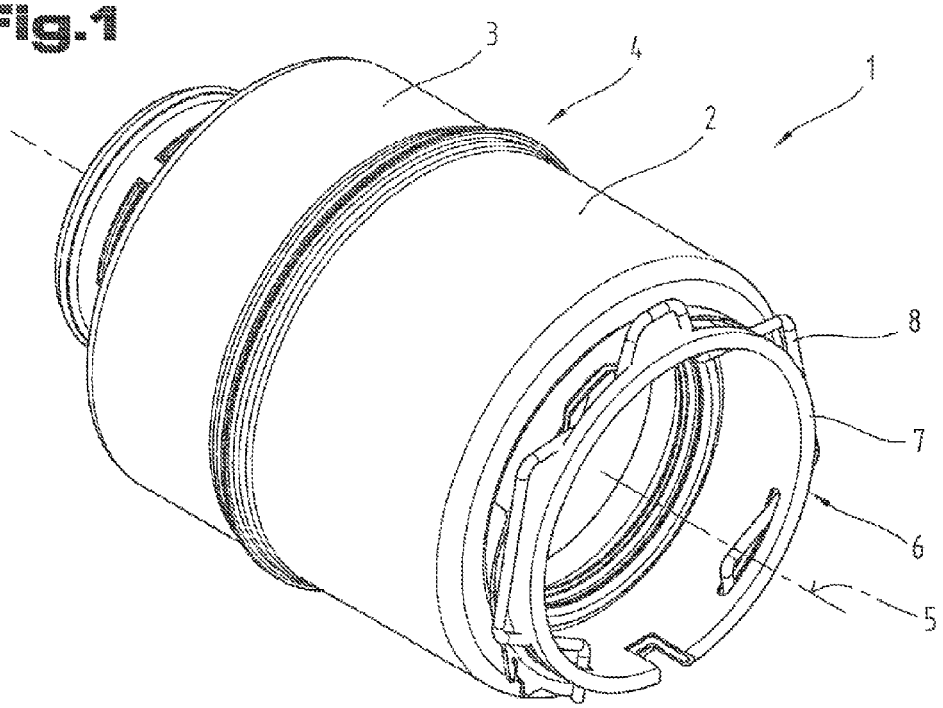

(51) Int. Cl.

| | |
|---|---|
| ***F01N 13/18*** | (2010.01) |
| ***F02B 33/44*** | (2006.01) |
| ***G10K 11/16*** | (2006.01) |
| ***G10K 11/172*** | (2006.01) |

(52) U.S. Cl.
CPC ..... *F02M 35/1283* (2013.01); *G10K 11/161* (2013.01); *G10K 11/172* (2013.01)

(58) Field of Classification Search
USPC ..... 181/229, 250, 266, 273, 276
See application file for complete search history.

(56) References Cited

U.S. PATENT DOCUMENTS

2003/0085071 A1* 5/2003 Boast ..... F01N 1/003 181/249
2011/0073406 A1* 3/2011 Ortman ..... F02B 33/44 181/276
2012/0090915 A1* 4/2012 Cheung ..... F02M 35/1216 181/224
2014/0116801 A1* 5/2014 Andre ..... F01N 1/10 181/213

FOREIGN PATENT DOCUMENTS

| | | | |
|---|---|---|---|
| DE | 10 2008 007 961 | B3 | 7/2009 |
| DE | 10 2008 015 353 | A1 | 9/2009 |
| DE | 10 2010 020 064 | A1 | 11/2011 |
| EP | 0 959 302 | A2 | 11/1999 |
| EP | 2 067 979 | A1 | 6/2009 |
| FR | 2 881 191 | A1 | 7/2006 |
| FR | 2 983 919 | A1 | 6/2013 |
| WO | 01/25611 | A1 | 4/2001 |
| WO | 2005/103550 | A1 | 11/2005 |
| WO | 2007/101412 | A1 | 9/2007 |

* cited by examiner

MUFFLER

CROSS REFERENCE TO RELATED APPLICATIONS

This application is the National Stage of PCT/AT2015/050059filed on Mar. 6, 2015, which claims priority under 35 U.S.C. § 119 of Austrian Application No. 50168/2014 filed on Mar. 7, 2014, the disclosure of which is incorporated by reference. The international application under PCT article 21(2) was not published in English.

The invention relates to a muffler, in particular a vehicle muffler, and a vehicle equipped with this muffler.

WO 07101412 A1 discloses a muffler based on a modular construction and the manufacture thereof. A plurality of resonator elements is provided for this purpose, which form a labyrinth of passages and resonator chambers.

The disadvantage of this construction is the fact that the parts connected to another due to the modular construction have to be assembled in a complicated production process, which makes exact positioning of the individual parts very difficult and places high demands on the positioning accuracy of the machines.

DE 10026355 A1 discloses a sound damping air line for an air duct of an internal combustion engine comprising an inner duct with radial holes and a sound damping cladding at least partially covering the inner duct radially on the outside. An outer duct completely surrounds the inner duct and sound damping cladding. Both the outer duct and the inner duct are each made from two half shells, one half shell of the inner duct being hinge-mounted on a half shell of the outer duct and the other half shell of the inner duct being hinge-mounted on the other half shell of the outer duct. The inner duct, outer duct and sound damping cladding are made from plastic.

The disadvantage of this construction is that the manufacture of such an air line is enormously complex. In particular, the process of hinge mounting the individual half shells requires several complex operations and in terms of cost, is only economically feasible if using plastic materials. Accordingly, this solution must be ruled out in the case of all applications which require the use of metal, e.g. stainless steel.

The objective of this invention is to propose a muffler with a coupling connection, in which the coupling connection is advantageously integrated in the muffler in order to make it easier to connect a component to the muffler.

This objective is achieved by the invention on the basis of the features according to the invention.

The invention proposes a muffler, in particular a vehicle muffler, comprising at least one resonator chamber. The resonator chamber is bounded by at least a first housing part having a first outer jacket and having a first end wall in which an inflow opening is arranged, disposed on the inflow side, and a first internal pipe segment. The muffler further comprises at least one coupling device for coupling to a turbocharger which is accommodated in the first end wall of the first housing part, which coupling device comprises a coupling body. The coupling body is a shaped sheet metal part, such as a deep-drawn part, and the first housing part is likewise formed integrally from a shaped sheet metal part, such as a deep-drawn part, and the inflow opening of the first housing part has an extension which is tapered in steps in an axial section, in which the coupling body and a sealing element, such as a radial sealing ring, are accommodated. The advantage of using shaped sheet metal parts, especially deep-drawn parts, is that the individual parts can be based on a complex geometry. Deep-drawn parts can be produced economically in terms of resources because deep-drawn parts require very little cutting and thus create little material wastage. Furthermore, repeatability is very good when producing deep-drawn parts, which makes this manufacturing process very suitable for mass production. The deep drawing process also results in a certain degree of strain-hardening of the individual components, which also has a positive effect on the strength of the individual components.

An advantage of the design proposed by the invention is that the coupling device, in particular the coupling body, can be very easily connected to a first housing part of the muffler. In this connection, a sealing element can advantageously be accommodated in the muffler, thereby enabling a part to be coupled with the coupling device of the muffler and sealed. The connection between the housing part and coupling body is also easy to produce, so that such a muffler can advantageously be produced in particular in an industrial manufacturing process on a mass production basis. This results in high process reliability and cost-effective production. The muffler is also very easy to assemble and is therefore robust with little susceptibility to faults.

It may also be of practical advantage if the coupling body has an outer jacket provided in the form of a fixing portion and the fixing portion is adjoined by an end wall which extends in the direction of the cross-section center and which is provided as an axial stop element. The advantage of this is that such a fixing portion of the coupling body can advantageously be connected to the first housing part. The end wall of the coupling body can then be used as a stop element for positioning the coupling body relative to the first housing part.

Furthermore, the end wall of the coupling body may be provided with an over-beading on its inner portion, as viewed radially. The advantage of such an over-heading is that it imparts good stability to the end wall. As a result, the end wall is also able to withstand axial forces without being susceptible to excessive deformation.

Furthermore, in the extension tapered in steps, the first end wall of the first housing part is adjoined by a first axial portion which extends in the direction of the resonator chamber and which is provided in the form of a coupling mount, and the coupling body is accommodated in its first internal wall, and the coupling body lies with its outer jacket against the internal wail of the coupling mount. The advantage of this is that the coupling body can be precisely positioned relative to the first housing part and readily accommodated in the first housing part.

Also of advantage is a feature whereby the first axial portion of the housing part is adjoined by a first radial portion which extends in the direction of the cross-section and which serves as an axial stop for the coupling body, and the end wall of the coupling body lies against the first radial portion. The advantage of this is that the coupling body can be positioned relative to the first housing part in the axial direction.

Based on another embodiment, the first radial portion is adjoined by a second axial portion which extends in the direction of the resonator chamber and which serves as a seal mount, and the sealing element is accommodated on its second internal wall, and the second axial portion has a smaller cross-sectional dimension than the first axial portion. The advantage of this is that the sealing element can be accommodated in this cross-section, thereby enabling a seal to be provided for another component.

It may also be of practical advantage if the second axial portion of the housing part is adjoined by a second radial portion which extends in the direction of the cross-section center and which serves as an axial stop for the sealing element. The advantage of this is that the sealing element is also accommodated in the axial direction, secured in the first housing part.

Furthermore, the second radial portion is adjoined by a third axial portion which extends in the direction of the resonator chamber and which is provided in the form of an internal pipe segment, and the third axial portion has a smaller cross-sectional dimension than the second axial portion. The advantage of this is that an internal pipe segment for creating a resonator chamber is formed by the first housing part. This obviates the need for additional components to make an internal pipe segment and avoids a complex construction of the muffler involving several individual parts.

Furthermore, the axial distance between a first stop surface of the first radial portion and a second stop surface of the second radial portion is slightly bigger than an axial extension of the sealing element The advantage of this is that the sealing element can be accommodated, axially secured in the muffler, and the sealing element is nevertheless not subjected to axial load in the assembled state and the sealing effect is not detrimentally affected.

It is also of practical advantage that the end wall of the coupling body extends farther in the direction of the cross-section center than the internal wail of the second axial portion, as a result of which the end wall forms a part-region extending beyond the second axial portion, and as a result of which the sealing element is accommodated in the extension tapered in steps, secured to prevent axial movement. The advantage of this is that the sealing element can be accommodated in the muffler, axially secured, without having to use additional components. This minimizes the complexity of producing such a muffler and thus increases process reliability during the manufacturing operation.

Based on another advantageous embodiment, the fixing portion of the coupling body is connected to the first axial portion and/or to the end wall of the first housing part by a cohesively bonded connection, such as a welded connection, in particular a laser welded connection. The advantage of this is that such a cohesively bonded connection is easy to produce and is also suitable for providing an adequate connection of the individual components. Another advantage of a laser welded connection is that the heat introduced into the welded connection is locally limited and the surfaces on which the sealing element lies do not become too hot, thereby protecting the sealing element.

Alternatively, the end wall of the coupling element may be connected to the first radial portion of the first housing part by a cohesively bonded connection, such as a welded connection, in particular a laser welded connection. The advantage of this is that such a cohesively bonded connection is easy to produce and is also suitable for providing an adequate connection of the individual components. Another advantage of a laser welded connection is that the heat introduced into the welded connection is locally limited and the surfaces on which the sealing element lies do not become too hot, thereby protecting the sealing element.

Based on another alternative variant, the fixing portion of the coupling body is connected to the first axial portion of the first housing part by a positive connection, such as a press-fit connection. The advantage of this is that such a press-fit connection is easy to produce. Accordingly, this connection is particularly suitable for mass production. A positive connection also obviates the need for a welded connection, thereby avoiding the introduction of heat into the muffler 1 and hence thermal distortion.

The advantage of the design proposed by the invention is that the muffler is made up of as few individual parts to be assembled with one another as possible. This keeps production complexity to a minimum because as few welded connections as possible are needed. The reliability of the muffler can therefore be increased and production costs for such a muffler can also be kept to a minimum. Another advantage of such a muffler proposed by the invention is that thermal stress to the individual components during the manufacturing process can be kept as low as possible. Accordingly, internal stress in the individual parts of the muffler and distortion caused by internal stress can be minimized as far as possible and/or avoided.

To provide a clearer understanding, the invention will be described in more detail below with reference to the appended drawings.

Figure 3:
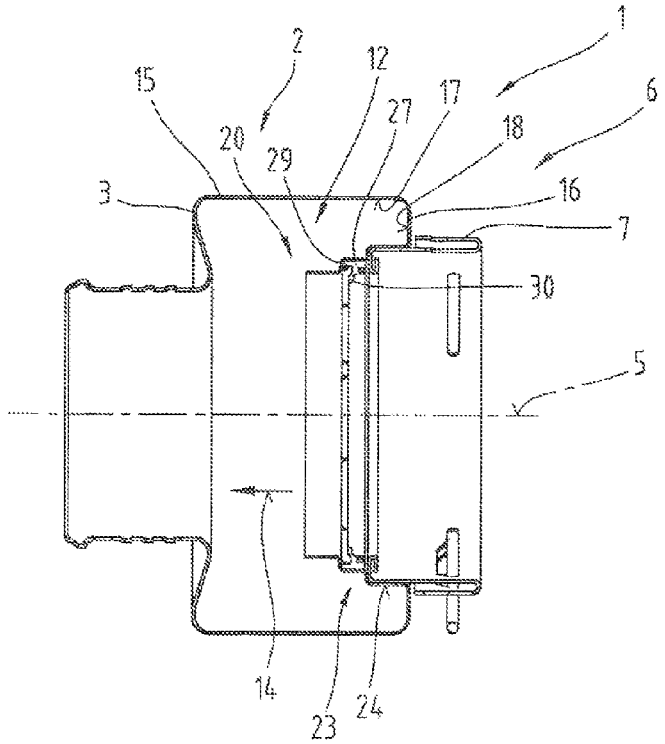
Figure 2:
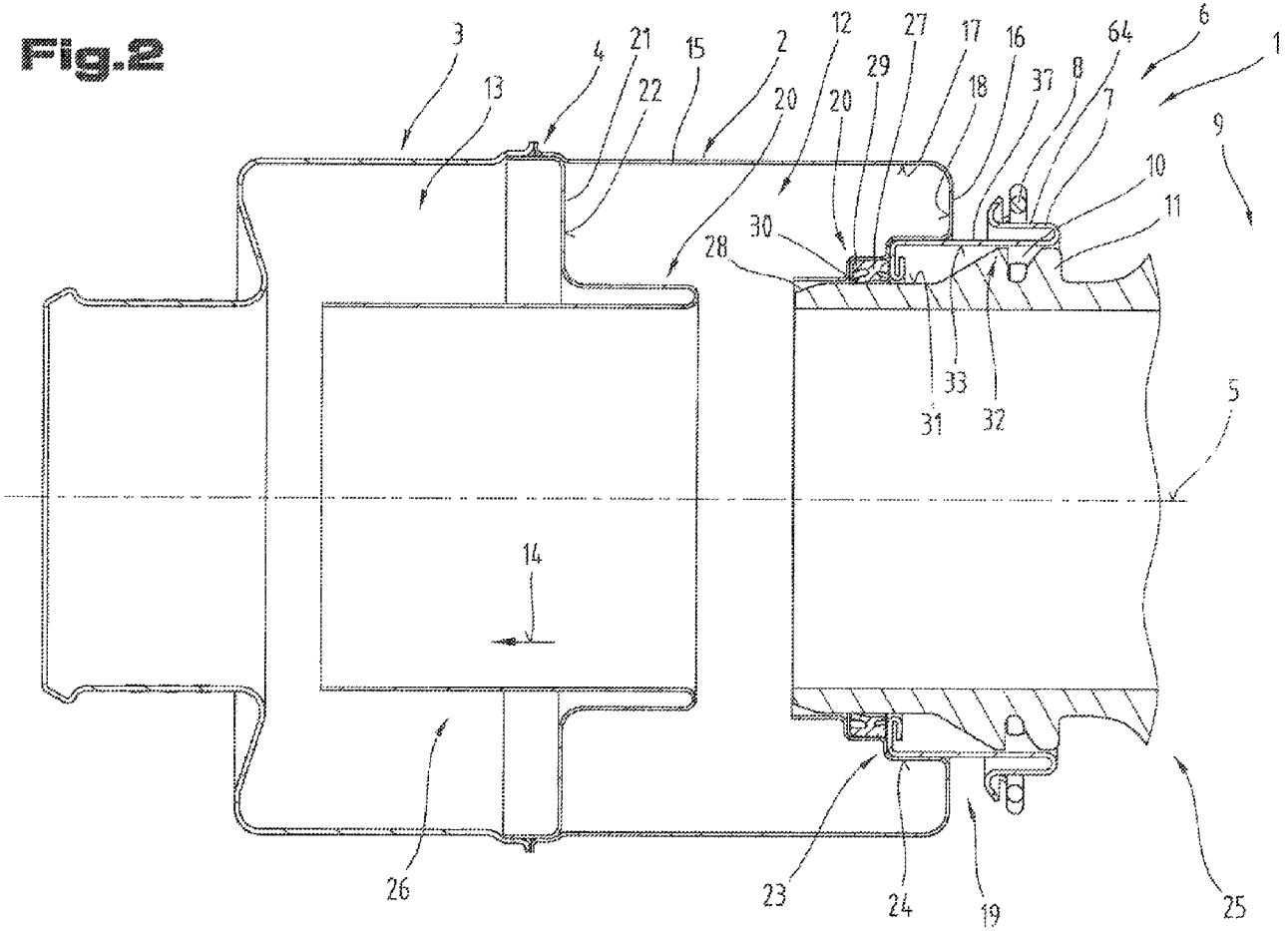
Figure 4:
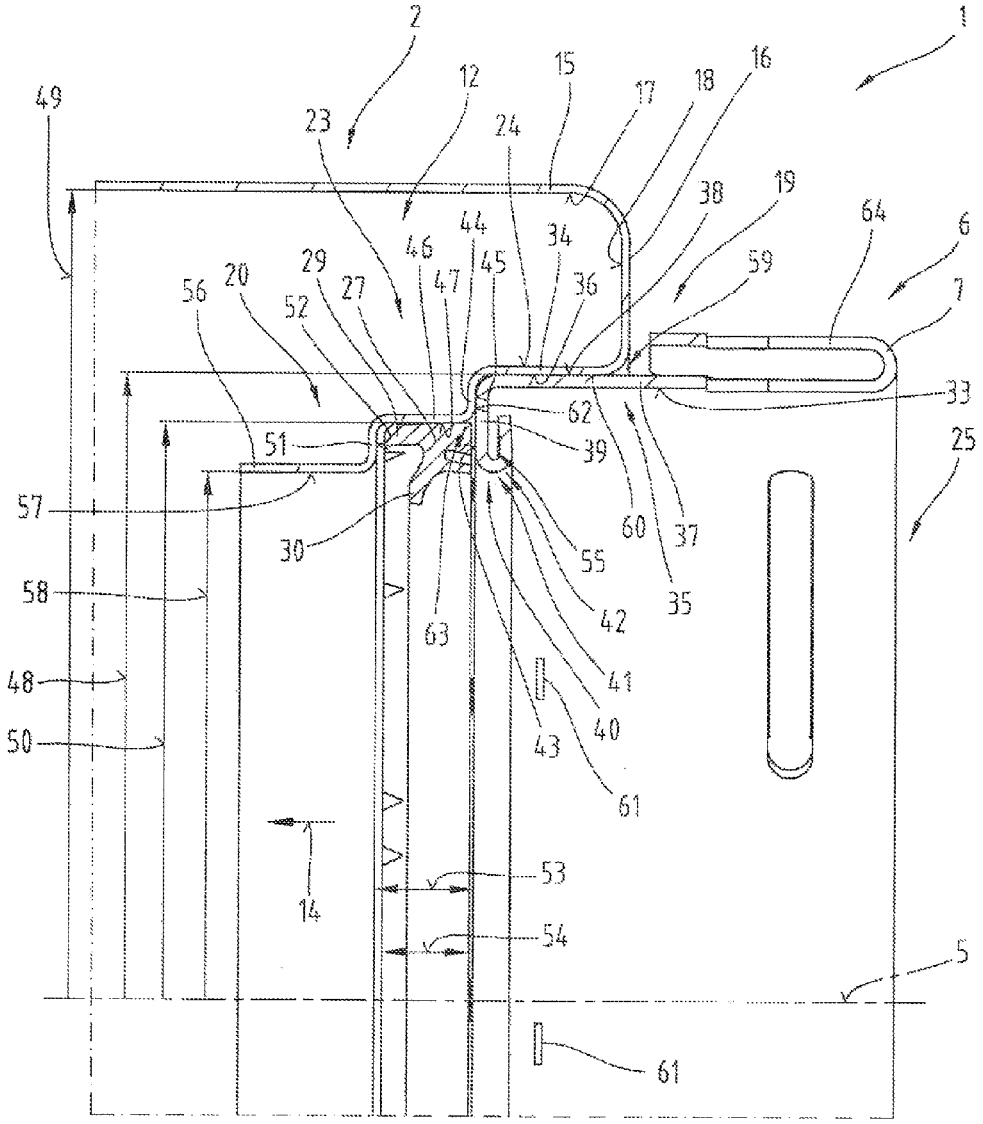
Figure 5:
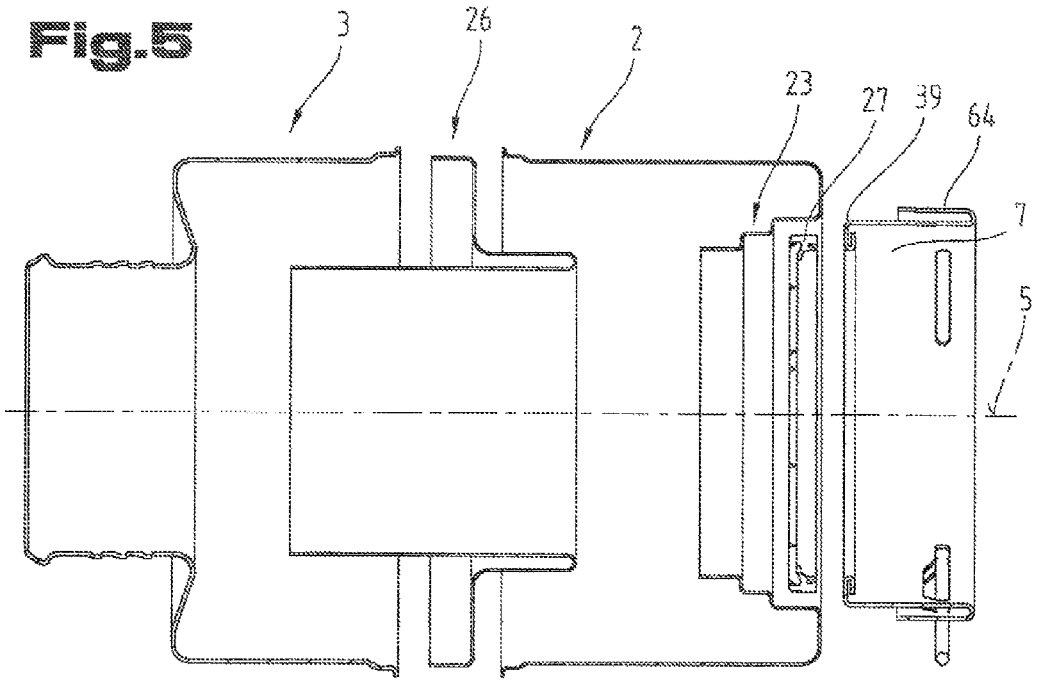
Figure 6:
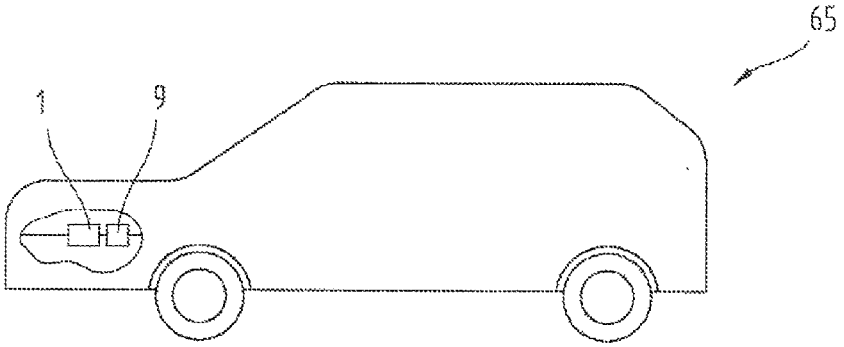
Figure 7:
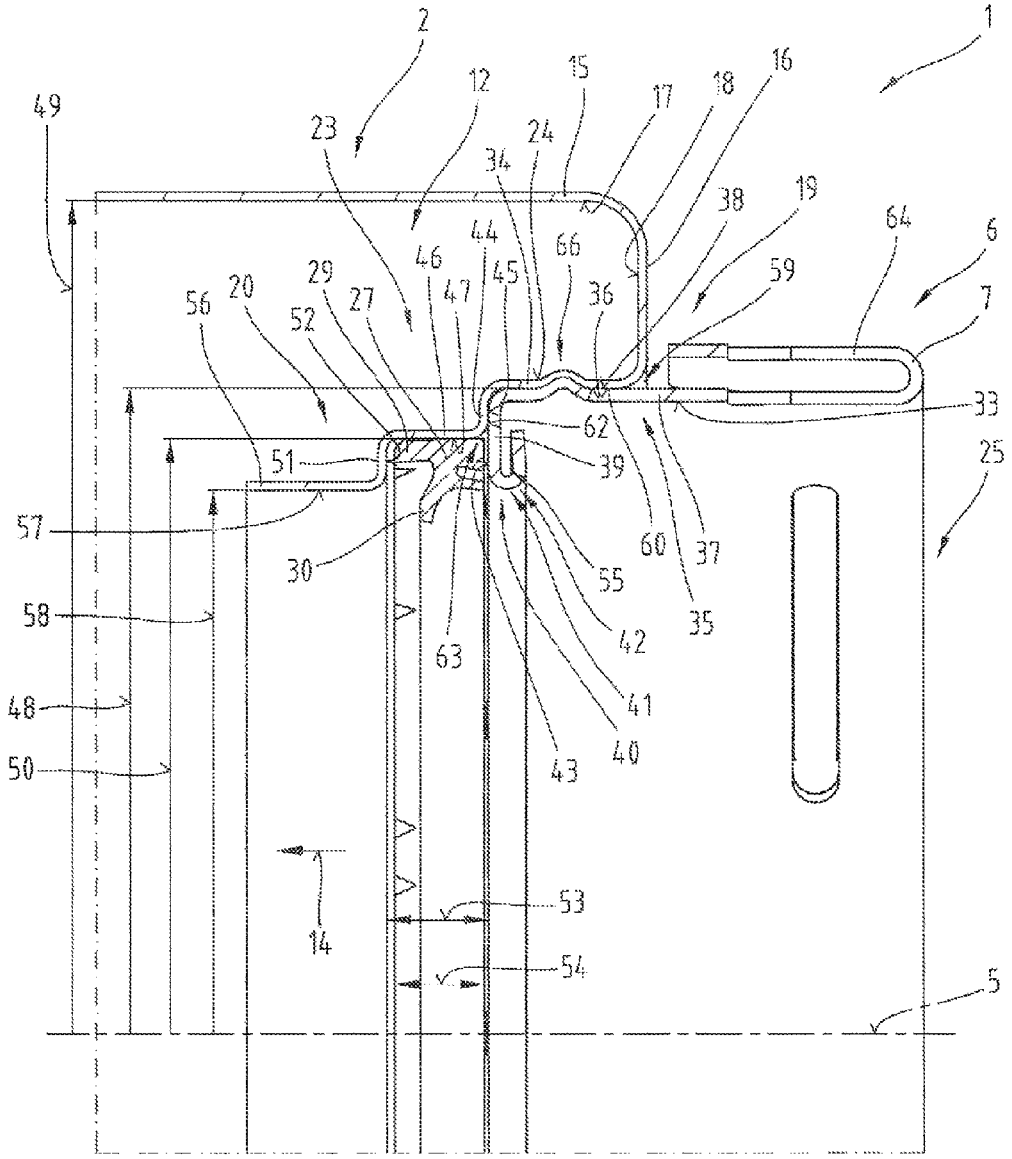

These are highly simplified, schematic diagrams illustrating the following:

FIG. 1 a perspective view of a muffler;

FIG. 2 a diagram in section showing a muffler in section along its center line;

FIG. 3 a diagram in section of another example of an embodiment of a muffler in section along its center line;

FIG. 4 a diagram in section of a muffler with a detail showing the coupling connection, based on a cohesive material connection;

FIG. 5 an exploded view of a muffler;

FIG. 6 a vehicle with a muffler connected to the turbocharger;

FIG. 7 a diagram in section of a muffler with a detail showing the coupling connection, based on a press-fit connection.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described.

FIGS. 1 and 2 illustrate a first embodiment of a muffler 1, in particular a vehicle muffler.

FIG. 1 is a perspective view of the muffler 1. The muffler 1 in this view comprises a first housing part 2 and a second housing part 3, which are connected to one another in a connection region 4. However, it would also be possible to provide a one-piece housing which forms the interior of the muffler. The muffler 1 is provided in the form of a rotationally symmetrical hollow body and thus has a central axis 5. The embodiment of the invention described in more detail below is not restricted to a rotationally symmetrical hollow body and it would also be conceivable for the muffler 1 to have an approximately rectangular or polygonal cross-section.

A coupling-device 6 is connected to the first housing part 2, the purpose of which is to enable the muffler 1 to be coupled with a turbocharger 9. In particular, the coupling device 6 is used as a means of enabling the muffler 1 to be removed from the turbocharger 9 and fitted back on the turbocharger 9 as quickly and easily as possible if necessary in the event of damage to the turbocharger 9 or in the event that an engine repair is necessary. The coupling device 6 comprises a coupling body 7 which is designed to be connected to and/or pushed onto a connector fitting of the turbocharger 9.

FIG. 2 shows a section through a muffler 1 along its central axis 5. In this diagram in section, the coupling device 6 and its coupling body 7 are clearly visible. A fixing element 8 may also be provided on the coupling device 6, by means of which the muffler 1 can be affixed to the turbocharger 9. As illustrated here, this fixing element 8 may be a wire bracket. This fixing element 8 may co-operate with a corresponding recess 10 in the turbocharger 9, respectively a recess 10 in a connector fitting 11 of the turbocharger 9.

In FIG. 2, the muffler 1 is illustrated in the fitted state and the connector fitting 11 of the turbocharger 9 is inserted in the muffler 1, respectively in the coupling device 6.

The illustrated muffler 1 further comprises a first resonator chamber 12 and a second resonator chamber 13. As viewed in a flow direction 14, the first resonator chamber 12 is disposed upstream of the second resonator chamber 13. Instead of two resonator chambers 12, 13, it would be possible to provide only one resonator chamber 12 or equally more resonator chambers. In terms of the design of the muffler 1 proposed by the invention, it is irrelevant how many resonator chambers it comprises and it is solely the design of the first, possibly also single, resonator chamber 12, respectively the first housing part 2 that matters.

Accordingly, the first resonator chamber 6 is bounded by a first outer jacket 15 and a first end wall 16. The first outer jacket 15 and the first end wall 16 are incorporated in the first housing part 2. To be more precise, the first resonator chamber 12 in the outer region thereof is bounded by a jacket internal face 17 of the first outer jacket 9 and by an internal end face 18 of the first end wall 16.

The first end wall 16 has an inflow opening 19 through which the medium, in particular the compressed intake air, is able to flow into the first resonator chamber 12.

The first resonator chamber 12 is also bounded by a first internal pipe segment 14 respectively by an outer jacket surface 15 of the first internal pipe segment 20 and by a chamber partition wall 21, respectively a first wall surface 22 of the chamber partition wall 21. In the case of an embodiment in which the muffler 1 has only one resonator chamber 12, the first resonator chamber 12 is directly adjoined by the first or second housing part 2, 3 instead of the chamber partition wall 21.

The inflow opening 19 also has an extension which is tapered in steps in an axial section 23 for accommodating the coupling device 6, in particular the coupling body 7. The tapering step-shaped extension 23 should be fitted in the first resonator chamber 12 so that it bounds the first resonator chamber 12 at the internal face thereof. In particular, an external jacket face 24 of the tapering step-shaped extension 23 bounds the first resonator chamber 12.

The first housing part 2 is therefore disposed on the inflow side 25 of the resonator, respectively the muffler 1.

In the embodiment illustrated in FIG. 2, the muffler 1, which has two resonator chambers, comprises a first housing part 2, a second housing part 3 and a resonator inner element 26. The resonator inner element 26 and the first housing part 2 and second housing part 3 are provided in the form of deep-drawn parts based on one advantageous embodiment. In particular, it is of advantage if the first housing part 2 is provided as a deep-drawn part.

In the following part of the description, the individual parts which make up the muffler 1 will be described exactly in terms of their design. However, it should be pointed out that the design of these individual parts is based on one advantageous embodiment of the muffler 1. Not all of the design features of the individual parts described here need necessarily be included in the design proposed by the invention or be as specifically described here.

The first housing part 2 comprises a first outer jacket 15. On the inflow side of the muffler 1, the first outer jacket 15 is adjoined by the first end wall 16, adjoining which is the inflow opening 19 and the extension 23 which is tapered in steps in an axial section for accommodating the coupling device 6. The first end wall 16 therefore adjoins the first outer jacket 15 and extends in the direction towards the center.

The muffler 1 further comprises a sealing element 27 which seals the first housing part 2 with respect to the connector fitting 11 of the turbocharger 9.

As may be seen in FIG. 2, in the fitted state in which it is pushed onto the connector fitting 11 of the turbocharger 9, the muffler 1 is secured by the fixing element 8 to prevent axial movement. The sealing element 27 provides the requisite sealing effect between the muffler 1 and connector fitting 11. The sealing element 27 is preferably provided in the form of a radial seal so that the muffler 1 can be easily fitted on the connector fitting 11 of the turbocharger 9 without any complications. To avoid damage to the sealing element 27 during the process of inserting the connector fitting 11, the connector fitting 11 may be provided with a chamfer 28 to facilitate fitting of the two parts with one another.

When the muffler 1 and turbocharger 9 are in the fitted state as illustrated in FIG. 2, a first sealing lip 29 of the sealing element 27 lies against the tapering step-shaped extension 23 of the first housing part 2 and a second sealing lip 30 lies against a sealing surface 31 of the connector fitting 11 of the turbocharger 9. As may also be seen, the connector fitting 11 is designed such that in the fitted state, a part-region of the external circumference 32 in conjunction with the coupling body 7, in particular with a jacket internal face 33 of the coupling body 7, forms a loose fit. This offers a very effective way of fixing the radial position of the muffler 1 relative to the turbocharger 9. Furthermore, the sealing surface 31 of the connector fitting 11 lies on the tapering step-shaped extension 23 of the first housing part 2 and thus also fixes the position of the muffler 1 relative to the turbocharger 9.

FIG. 3 illustrates another embodiment of the muffler 1 which may be construed as an independent embodiment in its own right, the same reference numbers and component names being used to denote parts that are the same as those described in connection with FIGS. 1 and 2 above. To avoid unnecessary repetition, reference may be made to the more detailed description of FIGS. 1 and 2 given above.

The embodiment of the muffler 1 illustrated in FIG. 3 has only a first resonator chamber 12. In addition to a first housing part 2, the muffler 1 illustrated here may also comprise a second housing part 3. However, it would also be possible for the first housing part 2 to be an integral part, in which case a second housing part 3 is not needed.

FIG. 3 illustrates the muffler 1 in an assembled state but the muffler 1 is not fitted on the connector fitting 11 of the turbocharger 9.

FIG. 4 illustrates a detail of the interface between the coupling device 6 and first housing part 2. Since the features of the muffler 1 proposed by the invention are disposed at this transition interface, it is irrelevant whether the muffler has one or more than one resonator chamber.

As may be readily seen from the view illustrated in FIG. 4, a first axial portion 34 adjoins the first end wall 16 of the first housing part 2 in the extension with tapered steps 23. The first axial portion 34 extends from the first end wall 16 in the direction of the first resonator chamber 12, i.e. in the axial direction away from the inflow side 25. The first axial portion 34 is designed as a coupling mount 35, and an internal wall 36 of the coupling mount 35 cooperates with and/or is connected to an outer jacket 37 of the coupling body 7. A fixing portion 38 is disposed in the outer jacket 37 of the coupling body 7 which contacts the internal wall 36 of the coupling mount 35.

Adjoining its outer jacket 37, the coupling body 7 also has an end wall 39 which is provided as an axial stop element 40. The end wall 39 extends from the fixing portion 38 in the direction of the cross-section center, and it may be that over-beading 42 is provided, in which case it lies on the inwardly lying portion 41 of the end wall 39 of the coupling body 7 as viewed radially. In this respect, it is preferable if the end wall 39 is over-beaded in the direction of the inflow side 25, thereby resulting in a smooth stop surface 43 on the end wall 39.

Furthermore, adjoining a first axial portion 34 of the first housing part 2, a first radial portion 44 is provided, which extends in the direction of the cross-section center. This radial portion 44 may be used as an axial stop for the coupling body. Accordingly, the end wall 39, in particular a stop surface 43 of the end wall 39 of the coupling body 7, lies on the first radial portion 44, in particular on a first stop surface 45 of the first radial portion 44.

Furthermore, adjoining the first radial portion 44 is a second axial portion 46 which extends from the radial portion 44 in the direction of the resonator chamber 12, i.e. away from the inflow side 25. The second axial portion 46 is designed as a seal mount and the sealing element 27 is accommodated on the second internal wall 47 thereof.

A cross-sectional dimension 48 of the first axial portion 34 is smaller than a cross-sectional dimension 49 of the first outer jacket 15. A cross-sectional dimension 50 of the second axial portion 46 is likewise smaller than a cross-sectional dimension 48 of the first axial portion 34. The sealing element 27 is adapted to the diameter of the second axial portion 46, in particular the second internal wall 47.

Adjoining the second axial portion 46 is a second radial portion 51 which extends in the direction of the cross-section center. This second radial portion 51 may be used as an axial stop for the sealing element 27. In particular, the second radial portion 51 forms a second stop surface 52, against which the sealing element 27 can be pressed.

The first radial portion 44 and the second radial portion 51 are positioned relative to one another in such a way that an axial distance 53 between the first stop surface 45 and between the second stop surface 52 is bigger than an axial extension 54 of the sealing element 27. This being the case, the sealing element 27 can be readily accommodated in the second axial portion 46.

Furthermore, the end wall 39 of the coupling body 7 may extend farther in the direction of the cross-section center than the internal wall 47 of the second axial portion 46. Accordingly, the end wall 39 forms a part-region 55 which extends beyond the second axial portion 46. In other words, the end wall 39 of the coupling body 7 extends farther in the direction of the cross-section center than the first radial portion 44 co-operating with the end wall 39.

What this achieves is that the sealing element 27 is axially secured between the end wall 39 of the coupling body 7 and between the second radial portion 51, positioned in particular between the stop surfaces 43 and 52. This ensures that when the muffler 1 is fitted on and/or removed from the connector fitting 11 of the turbocharger 9, the sealing element 27 cannot be pushed in the axial direction.

Furthermore, the second radial portion 51 may be adjoined by a third axial portion 56 which extends in the direction of the resonator chamber 12, i.e. at an end remote from the inflow side 25. An internal wall 57 of the third axial portion 56 may be used as a guide surface for accommodating and contacting the sealing surface 31 of the connector fitting 11. The cross-sectional dimension 58 of the third axial portion 56 is smaller than a cross-sectional dimension 50 of the second axial portion 46.

The individual axial portions and/or radial portions of the tapering step-shaped extension 23 described above may be simultaneously provided in the form of an internal pipe segment 20.

The coupling body 7 is preferably connected to the first housing part 2 by a cohesively bonded connection, such as a welded connection. In terms of the method of producing the welded connection, laser welding and/or plasma welding is preferably used. There are several different options in terms of positioning a weld seam by means of which the coupling body 7 can be connected to the first housing part 2.

For example, one option is to provide a first fillet weld 59 applied in the radius between the first end wall 16 and first axial portion 34 of the first housing part and outer jacket 37 of the coupling body 7.

Another option is to provide the weld seam in the form of a surface connection 60 between the fixing portion 38 of the coupling body 7 and the internal wall 36 of the coupling mount 35. This being the case, the outer jacket 37 of the coupling body 7 may be provided with slit-like recesses 61 for applying the welding energy.

Another option for a welded connection is to use a second surface connection 62 between the first stop surface 45 of the first radial portion 44 and the stop surface 43 of the end wall 39 of the coupling body 7. Here too, the end wall 39 of the coupling body 7 may have slit-like recesses, not illustrated, by means of which the welding energy can be introduced into the intermediate surface.

Another option is to provide a second fillet weld 63 positioned between a transition radius of the first radial portion 44 and the second axial portion 46 and the end wall 39 of the coupling body 7.

Another possibility, for example, is to provide another outer jacket 46 of the coupling body 7 which is designed and shaped so that it abuts with the first end wall 16 of the first housing part 2 and can be joined thereto by a welded connection.

FIG. 5 is an exploded diagram illustrating the muffler 1. This clearly illustrates how the muffler 1 is produced and assembled.

At the start of the production process, at least the first housing part 2 and the coupling body 7 are deep drawn to obtain their characteristic shape.

In another method step, the first housing part 2 is held by a device or a manipulator robot. The sealing element 27 can then be axially inserted in the housing part 2, in particular in the tapering step-shaped extension 23.

Once the sealing element 27 has been positioned relative to the first housing part 2, the coupling body 7 can be pushed into the tapering step-shaped extension 23 in another method step. At this stage, the coupling body 7 should be oriented so that the end wall 39 of the coupling body 7 is directed towards the first housing part 2. The coupling body 7 can be pushed into the first housing part 2 until the stop surface 43 of the end wall 39 lies against the first stop surface 45 of the first radial portion 44. The coupling body 7 does not therefore have to be axially positioned relative to the first housing part 2 but merely inserted therein as far as the stop.

During another method step, the coupling body 7 and first housing part 2 are connected to one another by a welded connection, in particular a laser or plasma welded connection. The advantage of a laser or plasma welded connection is that only very little heat has to be applied and is locally limited. As a result, the sealing element 27 is not damaged during the welding operation.

FIG. 6 illustrates a vehicle 65 with the turbocharger 9 and a muffler 1 as proposed by the invention connected to the pressure side of the turbocharger 9.

FIG. 7 illustrates another embodiment of the muffler 1 which may optionally be construed as an independent embodiment in its own right, the same reference numbers and component names being used to denote parts that are the same as those described in connection with FIGS. 1, 2 and 4 above. To avoid unnecessary repetition, reference may be made to the detailed descriptions of FIGS. 1, 2 and 4 given above.

As may be seen from FIG. 7, it is also conceivable for the coupling body 7 and first housing part 2 to be connected to one another by a positive connection rather than being welded to one another. This positive connection may be achieved in the form of a press-fit connection 66. Such a press-fit connection 66 can be produced particularly effectively between the first axial portion 34 and fixing portion 38 of the coupling body 7. To this end, these wall portions are shaped together to create the positive connection. This positive connection can be produced by means of a tool which is positioned inside the coupling body 7 and pushes the fixing portion 38 of the coupling body 7 outwards. The positive connection can be then be obtained by a circumferentially extending press-fit connection 66. However, another option would be a press-fit connection 66 in only circumferentially extending segments.

The embodiments illustrated as examples represent possible variants of the muffler 1, and it should be pointed out at this stage that the invention is not specifically limited to the variants specifically illustrated, and instead the individual variants may be used in different combinations with one another and these possible variations lie within the reach of the person skilled in this technical field given the disclosed technical teaching.

Furthermore, individual features or combinations of features from the different embodiments illustrated and described may be construed as independent inventive solutions or solutions proposed by the invention in their own right.

The objective underlying the independent inventive solutions may be found in the description.

All the figures relating to ranges of values in the description should be construed as meaning that they include any and all part-ranges, in which case, for example, the range of 1 to 10 should be understood as including all part-ranges starting from the lower limit of 1 to the upper limit of 10, i.e. all part-ranges starting with a lower limit of 1 or more and ending with an upper limit of 10 or less, e.g. 1 to 1.7, or 3.2 to 8.1 or 5.5 to 10.

Above all, the individual embodiments of the subject matter illustrated in FIGS. 1 and 2, 3, 4 constitute independent solutions proposed by the invention in their own right. The objectives and associated solutions proposed by the invention may be found in the detailed descriptions of these drawings.

For the sake of good order, finally, it should be pointed out that, in order to provide a clearer understanding of the structure of the muffler 1, it and its constituent parts are illustrated to a certain extent out of scale and/or on an enlarged scale and/or on a reduced scale.

| List of reference numbers | |
|---|---|
| 1 | Muffler |
| 2 | First housing part |
| 3 | Second housing part |
| 4 | Connection region |
| 5 | Central axis |
| 6 | Coupling device |
| 7 | Coupling body |
| 8 | Fixing element |
| 9 | Turbocharger |
| 10 | Recess |
| 11 | Connector fitting |
| 12 | First resonator chamber |
| 13 | Second resonator chamber |
| 14 | Flow direction |
| 15 | First outer jacket |
| 16 | First end wall |
| 17 | Jacket internal face |
| 18 | Internal end face |
| 19 | Inflow opening |
| 20 | Internal pipe segment |
| 21 | Chamber partition wall |
| 22 | First wall surface |
| 23 | step-shaped tapering extension |
| 24 | Jacket face |
| 25 | Inflow side |
| 26 | Resonator internal element |
| 27 | Sealing element |
| 28 | Chamfer |
| 29 | First sealing lip |
| 30 | Second sealing lip |
| 31 | Sealing surface |
| 32 | Part-region of external circumference |
| 33 | Jacket internal face of coupling body |
| 34 | First axial portion |
| 35 | Coupling mount |
| 36 | Internal wall of coupling mount |
| 37 | Outer jacket of coupling body |
| 38 | Fixing portion of coupling body |
| 39 | End wall of coupling body |
| 40 | Axial stop element |
| 41 | Radially inner portion |
| 42 | Over-beading |
| 43 | Stop surface |
| 44 | First radial portion |
| 45 | First stop surface |
| 46 | Second axial portion |
| 47 | Second internal wall |
| 48 | Cross-sectional dimension of first axial portion |
| 49 | Cross-sectional dimension of first outer jacket |
| 50 | Cross-sectional dimension of second axial portion |
| 51 | Second radial portion |
| 52 | Second stop surface |
| 53 | Axial distance |
| 54 | Axial extension |
| 55 | Protruding part-region |
| 56 | Third axial portion |
| 57 | Internal wall of third axial portion |
| 58 | Cross-sectional dimension of third axial portion |
| 59 | First fillet weld |
| 60 | First surface connection |
| 61 | Slit-like recess |
| 62 | Second surface connection |
| 63 | Second fillet weld |
| 64 | Other outer jacket of coupling body |
| 65 | Vehicle |
| 66 | Press-fit connection |

The invention claimed is:

1. A muffler comprising at least one resonator chamber which is bounded by at least a first housing part having a first outer jacket and having a first end wall in which an inflow opening is arranged disposed on the inflow side, and a first internal pipe segment, and at least one coupling device for coupling to a turbocharger, which is accommodated in the first end wall of the first housing part, and which coupling device comprises a coupling body, wherein the coupling body is designed as a shaped sheet metal part and the first housing part is designed as a shaped sheet metal part and the inflow opening of the first housing part has an extension which is tapered in steps in an axial section in which the coupling body and a sealing element are accommodated, wherein the coupling body has an outer jacket on which a fixing portion is disposed, and the fixing portion is adjoined by an end wall which extends in the direction of the cross-section center and which is provided as an axial stop element, and wherein the end wall of the coupling body is provided with an over-beading on its internal portion, as viewed radially.

2. A vehicle having a muffler disposed on the pressure side of a turbocharger, wherein the muffler is according to claim 1.

3. A muffler comprising at least one resonator chamber which is bounded by at least a first housing part having a first outer jacket and having a first end wall in which an inflow opening is arranged disposed on the inflow side, and a first internal pipe segment, and at least one coupling device for coupling to a turbocharger, which is accommodated in the first end wall of the first housing part, and which coupling device comprises a coupling body, wherein the coupling body is designed as a shaped sheet metal part and the first housing part is designed as a shaped sheet metal part and the inflow opening of the first housing part has an extension which is tapered in steps in an axial section in which the coupling body and a sealing element are accommodated, and wherein in the extension tapered in steps, the first end wall of the first housing part is adjoined by a first axial portion which extends in the direction of the resonator chamber and which is provided in the form of a coupling mount, and the coupling body is accommodated in its first internal wall, and the coupling body lies with its outer jacket against the internal wall of the coupling mount.

4. The muffler according to claim 3, wherein the first axial portion of the first housing part is adjoined by a first radial portion which extends in the direction of the cross-section center and which serves as an axial stop for the coupling body, and the end wall of the coupling body lies against the first radial portion.

5. The muffler according to claim 4, wherein the first radial portion is adjoined by a second axial portion which extends in the direction of the resonator chamber and which serves as a seal mount, and the sealing element is accommodated on its second internal wall, and the second axial portion has a smaller cross-sectional dimension than the first axial portion.

6. The muffler according to claim 5, wherein the second axial portion of the first housing part is adjoined by a second radial portion which extends in the direction of the cross-section center and which serves as an axial stop for the sealing element.

7. The muffler according to claim 6, wherein the second radial portion is adjoined by a third axial portion which extends in the direction of the resonator chamber, and the third axial portion has a smaller cross-sectional dimension than the second axial portion.

8. The muffler according to claim 6, wherein the axial distance between a first stop surface of the first radial portion and a second stop surface of the second radial portion is slightly bigger than an axial extension of the sealing element.

9. The muffler according to claim 5, wherein the end wall of the coupling body extends farther in the direction of the cross-section center than the internal wall of the second axial portion, as a result of which the end wall forms a part-region extending beyond the second axial portion, and as a result of which the sealing element is accommodated in the extension tapered in steps, secured to prevent axial movement.

10. The muffler according to claim 3, wherein the fixing portion of the coupling body is connected to the first axial portion and/or to the first end wall of the first housing part by a cohesively bonded connection.

11. The muffler according to claim 4, wherein the end wall of the coupling body is connected to the first radial portion of the first housing part by a cohesively bonded connection.

12. The muffler according to claim 3, wherein the fixing portion of the coupling body is connected to the first axial portion of the first housing part by a positive connection.

* * * * *